US009281150B2

(12) United States Patent
Warne

(10) Patent No.: US 9,281,150 B2
(45) Date of Patent: Mar. 8, 2016

(54) CIRCUIT BREAKER TRIP BLOCKING APPARATUS, SYSTEMS, AND METHODS OF OPERATION

(75) Inventor: Kevin R. Warne, Dawsonville, GA (US)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/371,612

(22) PCT Filed: Mar. 12, 2012

(86) PCT No.: PCT/US2012/028715

§ 371 (c)(1), (2), (4) Date: Jul. 10, 2014

(87) PCT Pub. No.: WO2013/137846

PCT Pub. Date: Sep. 19, 2013

(65) Prior Publication Data

US 2015/0035628 A1 Feb. 5, 2015

(51) Int. Cl.

| | |
|---|---|
| ***H01H 9/00*** | (2006.01) |
| ***H01H 71/24*** | (2006.01) |
| ***H01H 9/24*** | (2006.01) |
| ***H01H 71/52*** | (2006.01) |
| *H01H 71/50* | (2006.01) |

(52) U.S. Cl.

CPC ..... *H01H 71/2463* (2013.01); *H01H 9/24* (2013.01); *H01H 71/52* (2013.01); *H01H 71/505* (2013.01); *H01H 71/521* (2013.01)

(58) Field of Classification Search

CPC ..... H01H 9/20; H01H 9/02; H01H 9/00; H01H 71/24; H01H 71/12; H01H 73/00; H01H 73/02; H01H 3/20; H01H 75/00; H01H 75/12; H01H 23/00

USPC ..... 335/176

See application file for complete search history.

(56) References Cited

U.S. PATENT DOCUMENTS 2,673,264 A * 3/1954 Cole ..... H01H 71/7418 335/176
2,942,079 A * 6/1960 Dorfman ..... H01H 71/7463 335/174

(Continued)

FOREIGN PATENT DOCUMENTS

DE 102010032030 A1 1/2012
GB 1550485 A 8/1979

OTHER PUBLICATIONS

PCT International Search Report corresponding to PCT International Application No. PCT/US2012/028715 filed Mar. 12, 2012 (5 pages).

*Primary Examiner* — Shawki S Ismail
*Assistant Examiner* — Lisa Homza

(57) ABSTRACT

Embodiments disclose a trip blocking apparatus of a circuit breaker exhibiting no trip at OFF functionality. The trip blocking apparatus effectively blocks tripping of a trip bar when the circuit breaker is in the OFF configuration. The trip blocking apparatus has a trip blocking arm and a blocking lever. A first projection of the blocking lever is configured to contact a handle arm, and a second projection is configured to interfere with the trip blocking arm to block tripping of the trip bar responsive to handle arm motion. Actuator resetting and blocking apparatus and trip blocking assemblies and methods of operating the trip blocking assembly are provided, as are other aspects.

23 Claims, 8 Drawing Sheets

(56) References Cited

U.S. PATENT DOCUMENTS 3,125,651 A * 3/1964 Brumfield ..... H01H 71/2472 335/141
3,258,562 A * 6/1966 Hurtle ..... H01H 71/40 335/176
3,309,637 A * 3/1967 Jencks ..... H01H 71/7418 200/401
3,372,354 A * 3/1968 Myers ..... H01H 71/7463 335/176
3,412,351 A * 11/1968 Harper ..... H01H 71/528 335/175
3,559,120 A * 1/1971 Myers ..... H01H 9/10 335/176
3,575,679 A * 4/1971 Ellsworth ..... H01H 71/7463 335/176
3,652,961 A * 3/1972 Salvati ..... H01H 71/7418 335/176
3,748,620 A * 7/1973 Ellsworth ..... H01H 71/7436 335/176
3,758,887 A * 9/1973 Ellsworth ..... H01H 71/7463 335/176
3,777,293 A * 12/1973 Tuzuki ..... H01H 71/2454 335/176
3,873,950 A * 3/1975 Guschin ..... H01H 77/10 335/176
4,114,123 A * 9/1978 Grenier ..... H01H 71/7463 335/176
4,118,680 A * 10/1978 Borona ..... H01H 71/74 200/286
4,165,453 A * 8/1979 Hennemann ..... H01H 71/525 200/337
4,267,539 A * 5/1981 Guinan ..... H01H 71/7463 335/176
4,313,098 A * 1/1982 Salvati ..... H01H 71/7418 335/176
4,489,295 A * 12/1984 Altenhof, Jr. ..... H01H 71/1054 335/166
4,546,224 A * 10/1985 Mostosi ..... H01H 71/501 200/401
4,743,878 A * 5/1988 Ohishi ..... H01H 71/526 335/172
4,951,019 A * 8/1990 Gula ..... H01H 71/501 200/401
4,958,136 A * 9/1990 Maier ..... H01H 71/7463 335/176
4,983,939 A * 1/1991 Shea ..... H01H 71/7463 335/172
5,173,676 A * 12/1992 Mullins ..... H01H 71/527 335/172
5,184,717 A * 2/1993 Chou ..... H01H 71/501 200/327
5,200,724 A * 4/1993 Gula ..... H01H 71/501 200/401
5,296,664 A * 3/1994 Crookston ..... H01H 71/501 200/401
5,304,765 A * 4/1994 Parks ..... H01H 71/501 200/401
5,418,343 A * 5/1995 Faber ..... H01H 71/16 200/400
5,430,422 A * 7/1995 Gibson ..... H01H 71/1054 335/166
5,543,595 A * 8/1996 Mader ..... H01H 71/501 200/401
5,805,038 A * 9/1998 Palmer ..... H01H 71/504 335/176
6,031,438 A * 2/2000 Runyan ..... H01H 71/04 335/167
6,084,191 A * 7/2000 Kataya ..... H01H 71/525 200/400
6,087,913 A * 7/2000 Castonguay ..... H01H 71/525 200/400
6,160,470 A * 12/2000 O'Carroll ..... H01H 71/7436 200/286
6,172,584 B1 * 1/2001 Castonguay ..... H01H 71/505 335/172
6,175,288 B1 * 1/2001 Castonguay ..... H01H 71/2472 218/22
6,215,379 B1 * 4/2001 O'Keefe ..... H01H 71/164 335/172
6,218,919 B1 * 4/2001 Ciarcia ..... H01H 71/525 335/167
6,218,920 B1 * 4/2001 Reichard ..... H01H 71/7463 335/172
6,222,143 B1 * 4/2001 Lawson ..... H01H 71/501 200/401
6,225,881 B1 * 5/2001 Felden ..... H01H 71/04 335/167
6,229,413 B1 * 5/2001 Castonguay ..... H01H 1/2058 218/30
6,232,570 B1 * 5/2001 Castonguay ..... H01H 1/2041 200/237
6,239,677 B1 * 5/2001 Ramakrishnan ..... H01H 1/2058 335/172
6,400,245 B1 * 6/2002 Castonguay ..... H01H 1/2058 200/50.05
6,407,653 B1 * 6/2002 Zindler ..... H01H 71/7463 335/172
6,448,522 B1 * 9/2002 Rosen ..... H01H 1/2058 200/322
6,985,059 B2 * 1/2006 Subramanian ..... H01H 1/2058 335/16
7,098,416 B2 * 8/2006 Puhalla ..... H01H 71/465 200/330
7,199,319 B1 * 4/2007 Rodgers ..... H01H 71/0214 200/293
7,843,290 B2 * 11/2010 Song ..... H01H 71/501 200/401
2008/0122563 A1 * 5/2008 Song ..... H01H 71/7463 335/176

* cited by examiner

FIG. 1B
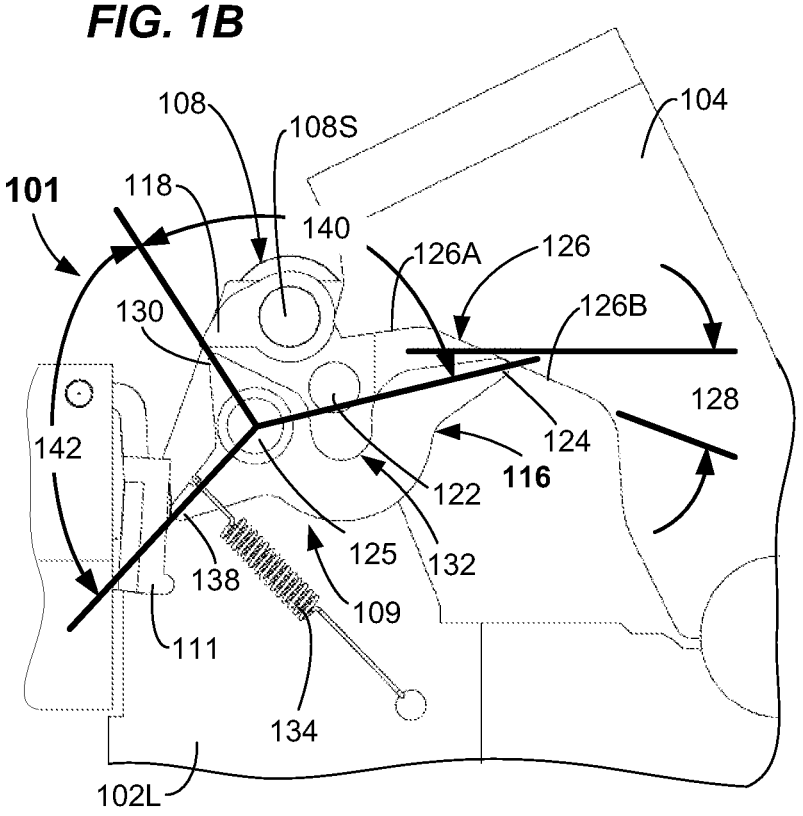
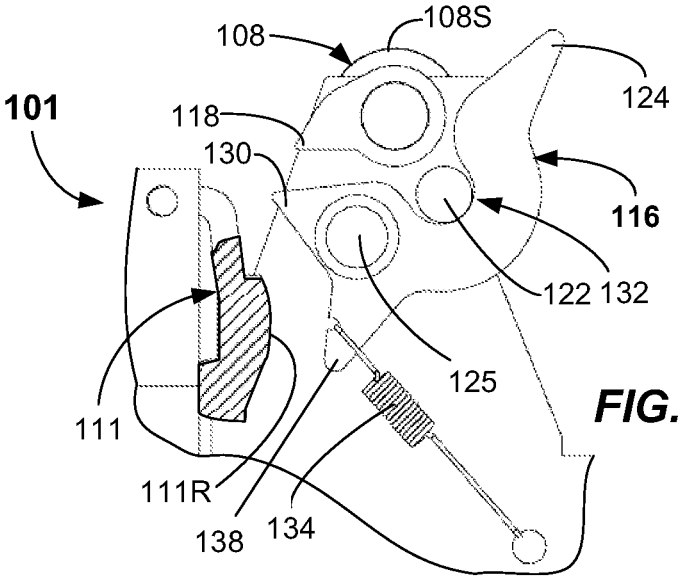
FIG. 1C

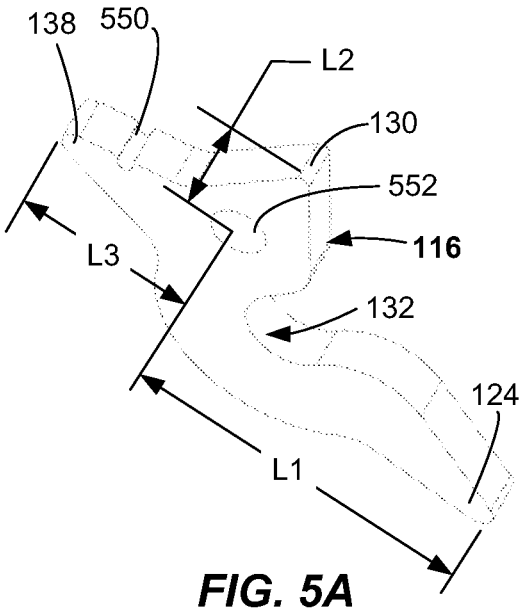
FIG. 5A
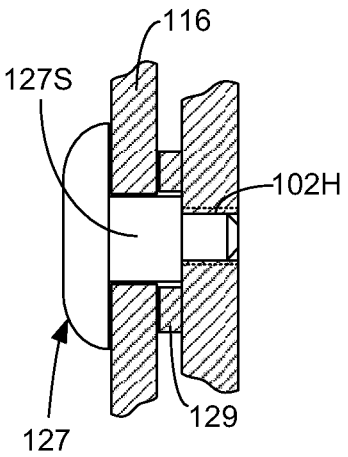
FIG. 5B
FIG. 5C
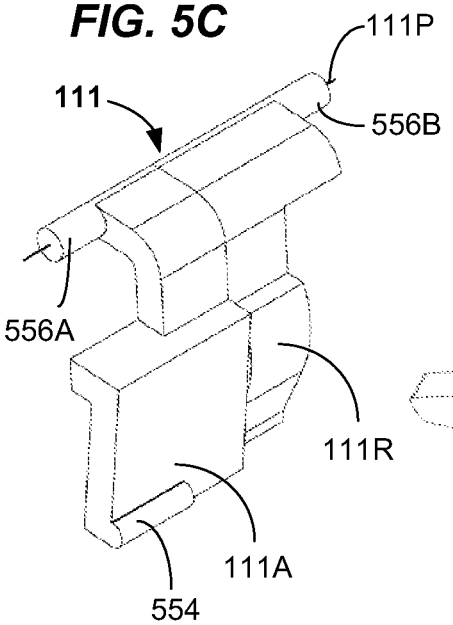
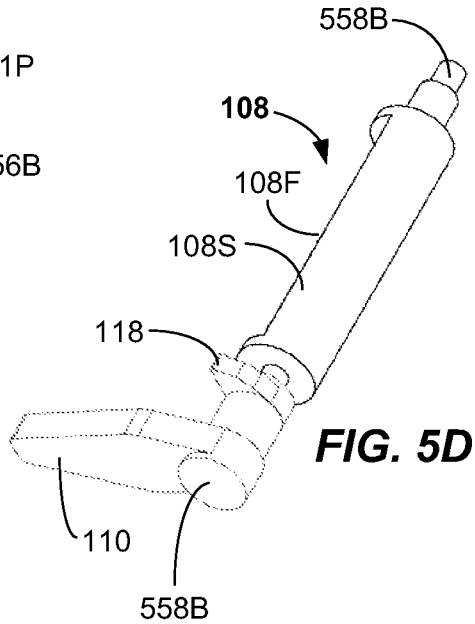
FIG. 5D

CIRCUIT BREAKER TRIP BLOCKING APPARATUS, SYSTEMS, AND METHODS OF OPERATION

FIELD

The present invention relates generally to circuit breakers for interrupting current from an electrical power supply, and more particularly to trip blocking mechanisms and methods for circuit breakers.

BACKGROUND

Circuit breakers are used in certain electrical systems for protecting an electrical circuit coupled to an electrical power supply. Such circuit breakers can include ON, OFF, TRIP, and RESET configurations. Certain circuit breakers, such as electronic circuit breakers, may be tripped under certain conditions when such tripping is unwanted. For various reasons, it is undesirable to have such unwanted trips. For example, it may lead to an undesired reaction in the system, such as activation of an integrated alarm switch. Moreover, such unwanted trips when in certain configurations may cause initiation of a follow up action to manually reset the breaker to a RESET configuration before it may again be moved into the ON configuration.

Accordingly, there is a need for a circuit breaker that cannot trip in certain configurations.

SUMMARY

In a first aspect, a circuit breaker trip blocking apparatus is provided. The circuit breaker trip blocking apparatus includes a trip bar having trip blocking arm, and a blocking lever having a first projection configured and adapted to contact a handle arm and a second projection configured and adapted to block tripping of the trip bar responsive to motion of the handle arm.

According to another aspect, a circuit breaker trip blocking apparatus is provided. The circuit breaker trip blocking apparatus includes a trip blocking arm, a tripping system having a kicker adapted to be moved by an actuator, and a blocking lever having a blocking projection configured and adapted to block the trip blocking arm, and a reset projection configured and adapted to reset the actuator.

According to another aspect, a circuit breaker trip blocking apparatus is provided. The circuit breaker trip blocking apparatus includes a tripping system having a kicker adapted to be moved by an actuator, and a blocking lever having a first projection configured and adapted to contact a handle arm, and a reset projection configured and adapted to reset the actuator and block actuation of the actuator in an OFF configuration.

In yet another aspect, a circuit breaker trip blocking assembly is provided. The circuit breaker trip blocking assembly includes a frame, a handle arm pivotable relative to the frame about a handle arm pivot, the handle arm including a profile surface, a trip bar having trip arm and a trip blocking arm, a tripping system having a kicker and an actuator, the trip arm adapted to be contacted by the kicker when moved by the actuator, and a blocking lever pivotable relative to the frame, the blocking lever having a first projection configured and adapted to contact the profile surface and a second projection adapted to interfere with the trip blocking arm to block tripping of the trip bar responsive to motion of the handle arm.

According to another aspect, a method of operating a circuit breaker trip blocking assembly is provided. The method includes providing a trip blocking arm, providing a blocking lever having a first projection configured and adapted to contact a handle arm, and a second projection configured and adapted to interfere with the trip blocking arm, and blocking tripping of the trip bar by blocking the trip blocking arm with the second projection responsive to motion of the handle arm to an OFF configuration.

Still other aspects, features, and advantages of the present invention may be readily apparent from the following detailed description by illustrating a number of example embodiments and implementations, including the best mode contemplated for carrying out the present invention. The present invention may also be capable of other and different embodiments, and its several details may be modified in various respects, all without departing from the scope of the present invention. Accordingly, the drawings and descriptions are to be regarded as illustrative in nature, and not as restrictive. The invention is to cover all modifications, equivalents, and alternatives falling within the scope of the invention.

BRIEF DESCRIPTION OF DRAWINGS

FIGS. 1B-1C illustrates two side views of components of a trip blocking apparatus shown in a blocked configuration (OFF) and unblocked configuration (ON or TRIP), respectively, according to embodiments.

FIG. 5A illustrates an isometric view of a blocking lever of a circuit breaker trip blocking assembly.

FIG. 5B illustrates a partial cross-sectional view of a pivot of a blocking lever of a circuit breaker trip blocking assembly.

FIG. 5C illustrates an isometric view of a kicker of an actuation system of circuit breaker trip blocking assembly.

FIG. 5D illustrates an isometric view of a trip bar of a circuit breaker trip blocking assembly.

DESCRIPTION

Certain conventional circuit breakers may have a propensity to trip when in the OFF configuration. Such tripping may be due to a Universal Voltage Regulator (UVR), a shunt, by pulling the circuit breaker out of its plug-in socket, or by pushing a mechanical push-to-trip. In view of the OFF configuration tripping exhibited by conventional circuit breakers, a circuit breaker having a trip blocking apparatus exhibiting no-trip-at-OFF functionality is provided. In particular, the circuit breaker trip blocking apparatus includes structure and function that prevents the circuit breaker tripping mechanism from tripping when in the OFF configuration. The circuit breaker trip blocking apparatus is configured and adapted to block tripping of the circuit breaker in the OFF configuration by interfering with a motion (e.g., rotation) of a trip bar of the circuit breaker.

In one or more embodiments, the circuit breaker trip blocking apparatus include a trip blocking arm, and a blocking lever having a first projection configured and adapted to contact a handle arm and a second projection configured and adapted to interfere with the trip blocking arm and block tripping of the circuit breaker responsive to motion of the handle arm. In operation, the blocking lever is moved (e.g., rotated) into a blocking orientation as a handle arm of the circuit breaker is moved to the OFF configuration. The blocking orientation may include alignment of the second projection of the blocking lever with the trip blocking arm to effectively block tripping of a trip bar. This effectively blocks the circuit breaker from tripping when in the OFF configuration due to one of the causes listed above or other causes. In one or more embodiments, the trip blocking apparatus may provide additional or alternative functionality to reset an actuator of a tripping system of the circuit breaker. Accordingly, in another broad aspect, the actuator of a tripping system of the circuit breaker may be reset by the motion of the blocking lever and also held so that the actuator cannot actuate in the OFF configuration.

In yet another broad aspect, a method of operating a circuit breaker trip blocking assembly is provided. The method causes blocking of a tripping mechanism (e.g., including a trip bar) when the circuit breaker is in the OFF configuration thereby preventing tripping in the OFF configuration.

Advantageously, the present invention solves a problem of the prior art, i.e., tripping when the circuit breaker is in the OFF configuration.

These and other embodiments of circuit breaker trip blocking apparatus, circuit breaker trip blocking assemblies, circuit breakers including the trip blocking apparatus, and methods of operating trip blocking assemblies are described below with reference to FIGS. 1A-6 herein. The drawings are not necessarily drawn to scale. Like numerals are used throughout the specification to denote like elements.

Figure 1A:
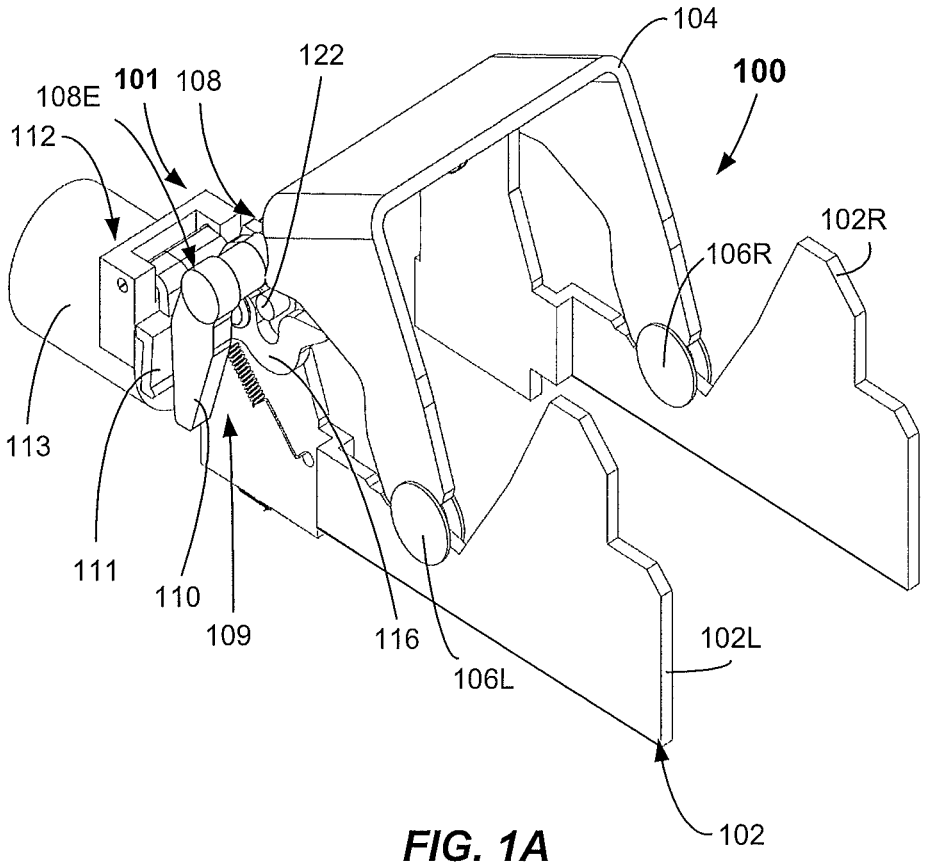
FIG. 1A illustrates an isometric view of a circuit breaker trip blocking assembly according to embodiments.

Referring now in specific detail to FIG. 1A-1C, a circuit breaker trip blocking assembly 100 including a circuit breaker trip blocking apparatus 101 is shown. Various configurations of the circuit breaker trip blocking assembly 100 are shown and described to enable understanding of the operation of the no trip at OFF features. The circuit breaker trip blocking assembly 100 will be referred to herein as a "circuit breaker trip blocking assembly," or simply "trip blocking assembly." "Circuit breaker" as used herein is a broad term for any switching component able to disconnect (open) an attached electrical circuit when certain electrical conditions are encountered. The trip blocking assembly 100 includes features and functions to prevent tripping when the circuit breaker into which it is installed is configured in the OFF configuration. Moreover, as will be apparent, the trip blocking assembly 100 may alternatively, or in addition, reset an actuator of an actuator system and also hold the actuator from actuating in the OFF configuration.

Referring again to FIGS. 1A-1C, the trip blocking assembly 100 includes a frame 102, which may be formed from several frame portions. According to some embodiments, the frame 102 may include a left frame 102L and right frame 102R. In the depicted embodiment, left and right frames 102L, 102R may be mounted to a larger housing assembly (e.g., a thermosetting plastic housing—not shown) through any suitable means, such as by fasteners or being captured in the housing or the like (not shown). As shown, a handle arm 104 is provided and mounted for rotation relative to the frame 102. In particular, the handle arm 104 may extend between side frames 102L, 102R and may mount to the frame 102 by the handle arm pivots 106L, 106R. Handle arm 104 may be of any conventional or any suitable construction. Movement of a handle (not shown) coupled to the handle arm 104 causes the setting the circuit breaker 100 in the various configurations such as an OFF configuration (FIG. 1), and an ON configuration (FIG. 4). Other configurations for the circuit breaker are possible, such as RESET. Tripping of the circuit breaker causes the assembly to move to a TRIP configuration. The frame 102 and handle arm 104 may be made from any suitably rigid material, such as stamped steel. Other materials may be used. Furthermore, other numbers of frame portions and constructions of the frame 102 and handle arm 104 may be used.

In more detail, the trip blocking assembly 100 includes a trip bar 108 that functions to rotate relative to journals of the frame 102 and cause tripping of the circuit breaker from the ON configuration (FIG. 4A-4B) to a TRIP configuration in response to a tripping event (i.e., any event that causes circuit breaker tripping such as due to operation of a bimetal element, operation of an electromagnetic actuator, or the like). As illustrated in FIG. 1A the trip bar 108 includes a shaft portion 108S (see FIGS. 3A and 5D) extending between the left frame 102L and right frame 102R and rotatable therein. The shaft portion 108S may interface with a latch mechanism (not shown) and rotation of the shaft 108S may trip the circuit breaker to a TRIP configuration. The trip bar 108 may be mounted for rotation in the frame 102 at both ends as shown in FIG. 3B. In the depicted embodiment, the trip bar 108 includes a flat surface that functions in operation to engage a latch (not shown). Release of the latch by the rotation of the trip bar 108 causes a release of a cradle (not shown) or other mechanism of the circuit breaker and causes tripping of the circuit breaker and separation of the main electrical contacts (not shown) thereby opening a protected electrical circuit electrically coupled to the circuit breaker. Any suitable latch, cradle and/or electrical contact assembly construction may be used. Other mechanism for engaging the tripping mechanism with the trip bar 108 may be used.

The trip bar 108 may include an extending portion 108E that may extend beyond the frame side 102L and is adapted to interface with a blocking assembly 109 described below herein. The trip bar 108 may also include a trip arm 110 extending generally radially from an axis of the shaft 108S of the trip bar 108. The trip arm 110 is adapted to be contacted by a tripping system 112, such as by a kicker 111 thereof that is functionally actuated upon a command signal to an actuator 113 (e.g., an electromagnetic actuator such as a solenoid). In some embodiments, when an electronic circuit (not shown) of the circuit breaker 100 senses a condition (e.g., an arc fault condition) that warrants tripping of the circuit breaker 100 to a TRIP configuration, an electrical signal may sent to the tripping system 112, which actuates actuator 113 into contact with the back of the kicker 111, and moves the kicker 111 into contact with the trip arm 110. This rotates the trip bar 108 and trips the circuit breaker, when in the ON configuration. However, when in the OFF configuration (e.g., due to a reset), the trip blocking apparatus 101 effectively blocks tripping as will be apparent from the following disclosure.

In more detail, the trip blocking apparatus 101 may be mounted at any convenient location within the circuit breaker assembly 100. In the depicted embodiment, the components of the trip blocking apparatus 101, as best shown in enlarged views of FIGS. 1A-1C and FIGS. 3A-4B, are mounted at a location adjacent to an outside surface of the left frame 102L. However, it should be understood that the trip blocking apparatus 101 may optionally be mounted to the right frame 102R or elsewhere on the frame 102 at a suitable location relative to the trip bar 108.

In the depicted embodiment, the trip blocking apparatus 101 includes a blocking lever 116 that is adapted to align with, and engage, both the handle arm 104 and a trip blocking arm 118 under certain conditions. The trip blocking apparatus 101 includes the blocking assembly 109 and the trip blocking arm 118. As will be apparent, the trip blocking apparatus 101 functions and operates to block and retrain motion of the trip bar 108 to a motion limit when the circuit breaker and circuit breaker trip blocking assembly 100 is in the OFF configuration.

The trip blocking apparatus 101 including the blocking assembly 109 and the trip blocking arm 118 is best shown in FIGS. 1B-1C. The blocking assembly 109 includes the blocking lever 116 that may be rotatable. The blocking lever 116 includes a first projection 124 configured and adapted to engage a profile portion 126 formed on the handle arm 104. The profile portion 126 may include a flat surface of sufficient length and width formed on an underside of the handle arm 104, for example. However, the profile portion 126 may be formed on any suitable portion of the handle arm 104. The handle arm 104 may have a suitable profile portion 126 so that as the handle is pushed towards the OFF configuration, the first projection 124 engages the profile portion 126 of the handle arm 104 and causes rotation of the blocking lever 116. Rotation of the blocking lever 116 may be clockwise about blocking lever pivot 125, as shown. Blocking lever pivot 125 may be formed, as shown in FIG. 5B, from a shaft 127S of a screw 127 extending through the blocking lever 116 and rotationally received in a threaded hole 102H formed in the frame 102L. The blocking lever 116 may be spaced from the frame 102L by any suitable spacer 129, such as a washer. Optionally, the spacing function may be provided by a stamped portion on the blocking lever 116. However, it should be understood that any suitable means for retaining the blocking lever 116 to the frame 102 and allowing free rotation thereof may be used, such as riveting or other types of fasteners.

The profile portion 126 may have a first incline 126A and a second incline 126B, which may be provided at angles relative to one another. The first incline 126A may be configured at an angle of about 6 degrees from the horizontal as the first portion 126A first contacts the first projection 124. The second incline 126B may be configured at an angle 128 of about 20 degrees from the horizontal in the OFF configuration as shown in FIG. 1B wherein the second portion 126A is in contact with the first projection 124. The blocking lever 116 may include a second projection 130 that may act as a blocking projection and is configured and adapted to engage and block the trip blocking arm 118 if inadvertently tripped in the OFF configuration. However, normally in the OFF configuration, the second projection 130 will be aligned with, but not in contact with the trip blocking arm 118. In the blocked configuration shown in FIG. 1B, rotation of the trip bar 108 of less than about 2 degrees is allowed before hard contact between the trip blocking arm 118 and second projection 130 of the blocking lever 116 is made. This is insufficient motion to cause tripping of the circuit breaker. However, other values of rotation that are insufficient to cause circuit breaker tripping may be used.

The blocking lever 116 may engage with a limit stop 122 when the blocking lever 116 is not engaged with the handle arm 104. For example, the blocking lever 116 may include a recess 132 that may engage with the limit stop 122. The blocking lever 116 may be biased into this at-rest position (FIG. 1C) under the action of a return spring 134. Optionally, the stopping function may be provided by a portion of the blocking lever 116 contacting a bent tab on the frame 102 or other motion-limiting geometrical feature. The return spring 134 may be connected to any suitable location of the frame 102. For example, as depicted, the return spring 134 may be attached to a hole in the frame (FIG. 1A). The return spring 134 may be attached to any suitable location on the blocking lever 116 on the other end. The return spring 134 may be a coil spring as shown or any other suitable spring to cause such spring biasing of the blocking lever 116. The spring 134 may have a spring rate of about 1 N/mm, for example. Other spring rates or spring types may be used.

In more detail, the blocking lever 116, as shown in FIGS. 1A-1C, may include a third projection 138. The third projection 138 may act as a resetting projection and may be configured and adapted to engage a resetting portion 111R (see FIG. 5C) coupled to the actuator 113. For example, the resetting portion may be a portion of the kicker 111 that is contacted by the third projection 138 as the handle arm 104 is moved to the OFF configuration. The resetting portion 111R may include a cam surface profile, as shown in FIGS. 1C and 5C. The cam surface profile of the resetting portion 111R may include any suitable radius. For example, the radius may be greater than about 25 mm in some embodiments. Other radiuses and surface profiles may be used, such as an inclined ramp or a combination of an inclined ramp and radius as shown. The contact of the third projection 138 with the cam surface profile of the resetting portion 111R as the circuit breaker is reset to a RESET configuration operates to reset the actuator 113 to a reset condition, so that the actuator 113 and tripping system 112 is again readied to trip the circuit breaker when the handle arm 104 is returned and set to an ON configuration. Thus, it should be understood that the circuit breaker trip blocking apparatus 101 may serve a dual purpose of: 1) blocking tripping in the OFF configuration, and 2) resetting the actuator 113 to a ready to actuate (e.g., retracted) condition. Optionally, the resetting feature may be broadly used by itself to reset the actuator. As will be apparent, the third projection may also hold the actuator 113 in the OFF configuration. As best shown in FIG. 5C, the kicker 111 includes a actuating portion 111A adapted to contact the trip arm 110 and the resetting portion 111R provided next to one another and each of which may pivot relative to a kicker pivot 111P formed with the housing of the actuator 113. The actuating portion 111A and the resetting portion 111R are rigidly coupled and preferably formed as one piece.

The operation of the trip blocking assembly 100 will now be described in more detail with reference to FIGS. 1A-4B. As the handle arm 104 is moved from the ON configuration (FIGS. 1C and 4A-4B) to the OFF configuration (FIGS. 1A and 3A-3B), the surface profile 126 of the handle arm 104 comes into engaging contact with the first projection 124 of the blocking lever 116. Upon further motion of the handle arm 104 to the OFF configuration, the second projection 130 is brought into alignment with the trip blocking arm 118 of the trip bar 108 as shown in FIG. 1B. In this blocking configuration, the second projection 130 is positioned and readied to block and limit rotation from the non-contacting position shown in FIG. 1B should there be an attempted trip of the circuit breaker attempt in the OFF configuration due to one of the causes mentioned above or another cause.

In FIG. 1B, the relative orientation between the projections 124, 130, 138 is shown. In particular, a first relative angle 140 between a midline extending through the blocking pivot 125 and an apex of the first projection 124, and a midline extending through the blocking pivot 125 and an apex of the second projection 130 may be between about 100 degrees and about 120 degrees, and in the depicted embodiment about 108 degrees. Similarly, a second relative angle 142 between a midline extending through the blocking pivot 125 and an apex of the second projection 130, and a midline extending through the blocking pivot 125 and an apex of the third projection 138 may be between about 100 degrees and about 120, and in the depicted embodiment about 107 degrees. Other angles may be used.

FIG. 1C illustrates a suitable clearance between the trip blocking arm 118 and the second projection 130 that allows tripping of the circuit breaker when the blocking lever 116 is in the ON configuration shown. The clearance is sufficient to allow tripping. The clearance may allow greater than about 8 degrees of rotation, greater than about 10 degrees of rotation, or even up to about 15 degrees of rotation of the trip bar 108 to allow tripping of the tripping mechanism (not shown). Any suitable tripping mechanism may be used with the trip blocking assembly 100. The trip blocking arm 118 and trip arm 110 may be separate components mechanically coupled to the trip shaft 108S. In some embodiments, coupling may be provided as shown in FIG. 5D, by providing the trip bar 108 as one integral piece (e.g., a casting).

Figure 3A:
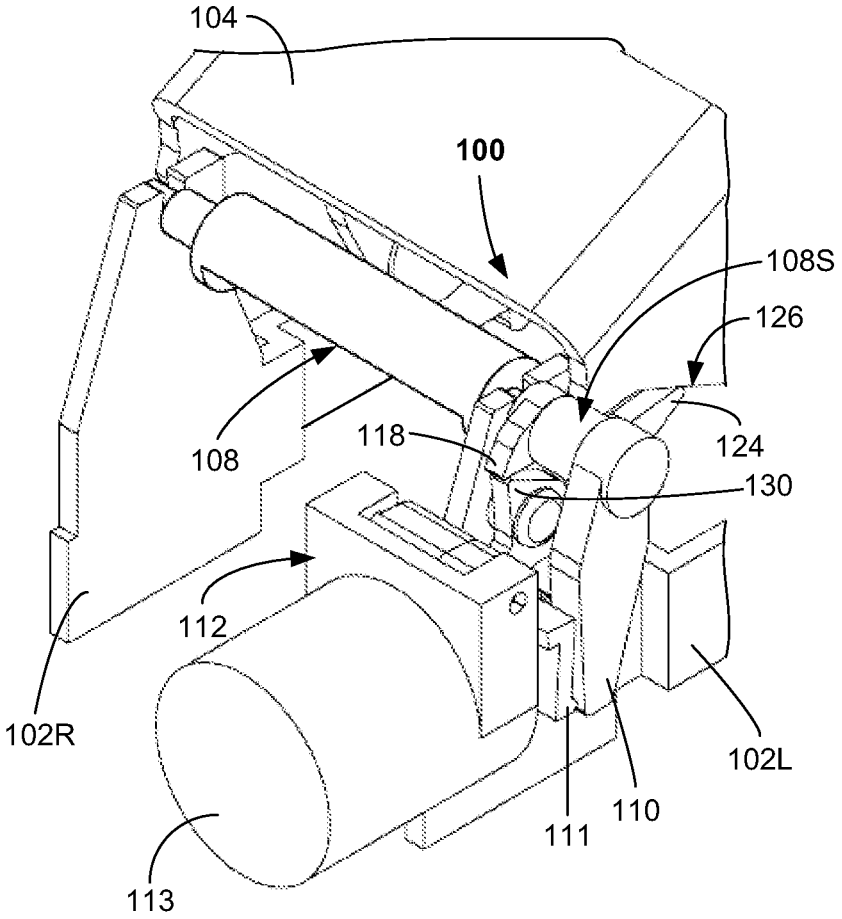
FIGS. 3A-3B illustrate partial isometric views of a trip blocking assembly of a circuit breaker shown in the OFF (blocked) configuration according to embodiments. The trip arm is shown removed in FIG. 3B for clarity.
Figure 3B:
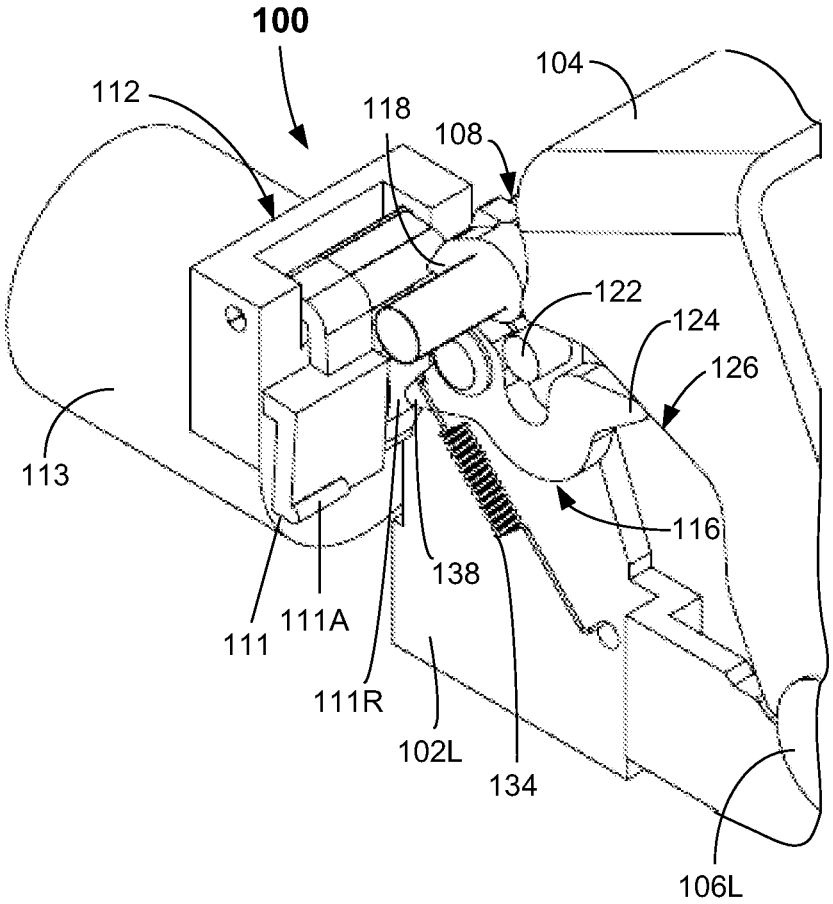

FIGS. 3A-3B and FIGS. 4A-4B illustrate a circuit breaker trip blocking assembly 100 configured in an ON or TRIP configuration (see FIGS. 4A and 4B), and moved to OFF configuration (see FIGS. 3A and 3B). FIG. 3B is shown with the trip arm 110 being removed for clarity. As can be seen from FIG. 3A, the trip blocking arm 118 may be spaced inwardly from the trip arm 110 and may be located between the left frame 102L and the trip arm 110. Both may extend radially from the shaft 108S of the trip bar 108. They may be rotationally misaligned from one another. As best seen in FIG. 3A, the second projection 130 is positioned via the rotation of the blocking lever 116 to interfere with and limit a rotation of the trip blocking arm 118 when in the OFF configuration.

FIG. 3B illustrates that the third projection 138 may act as a resetting projection and may be configured and adapted to engage the resetting portion 111R (see FIG. 5C) of the kicker 111 as the handle arm 104 is moved to and beyond the OFF configuration to the RESET configuration, resetting the circuit breaker. The contact of the third projection 138 with the resetting portion 111R operates to reset the actuator 113 to the reset configuration (e.g., a ready to actuate condition) so that the actuator 113 and tripping system 112 is again readied to trip the circuit breaker when the handle arm 104 is returned and set to the ON configuration. In addition, after the resetting and when the handle arm 104 returns to the OFF configuration under the force of an over-travel spring, the third projection 138 of the blocking lever 116 remains in contact with the resetting portion 111R of the kicker 111 and prevents the actuator 113 from actuating, i.e., it holds the actuator 113 and prevents it from firing in the OFF configuration. Thus, the third projection 138 acts as a reset projection configured and adapted to reset the actuator 113 and also hold and block actuation of the actuator 113 in an OFF configuration.

Figure 4A:
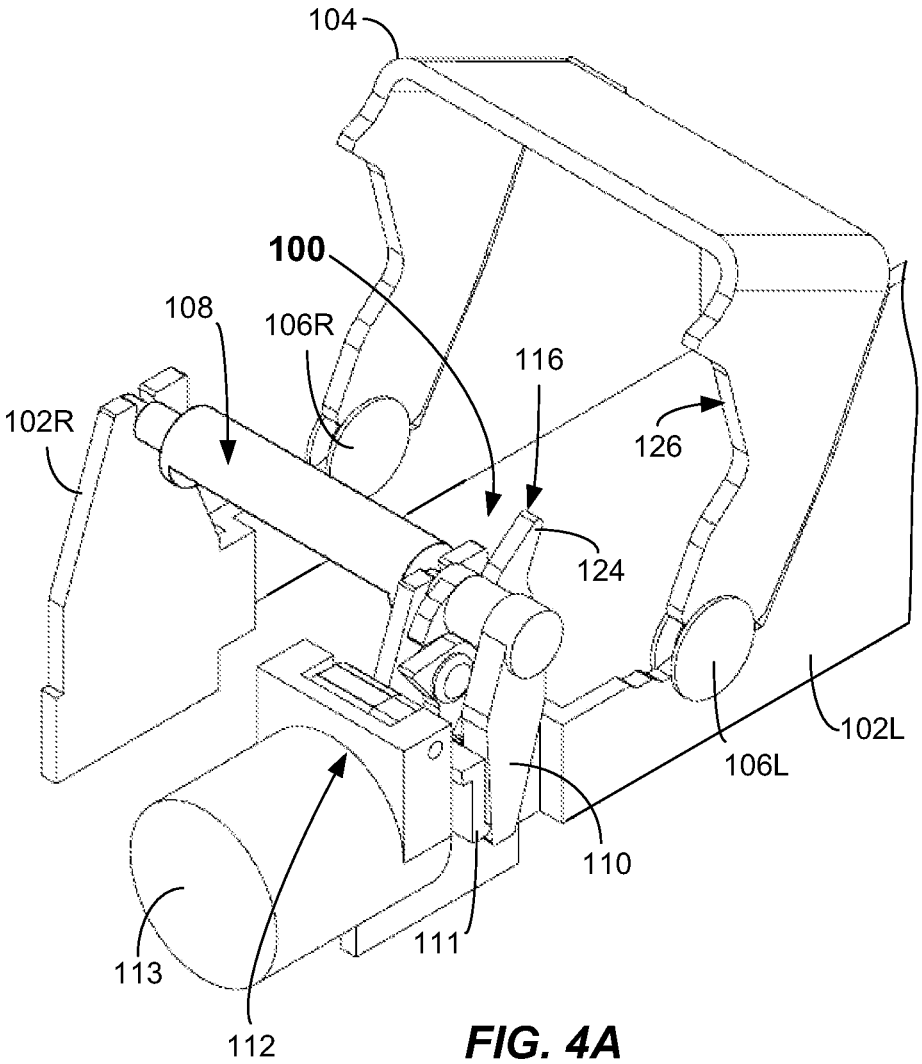
FIGS. 4A-4B illustrate partial isometric views of a trip blocking assembly of a circuit breaker shown in the ON (unblocked) configuration according to embodiments.
Figure 4B:
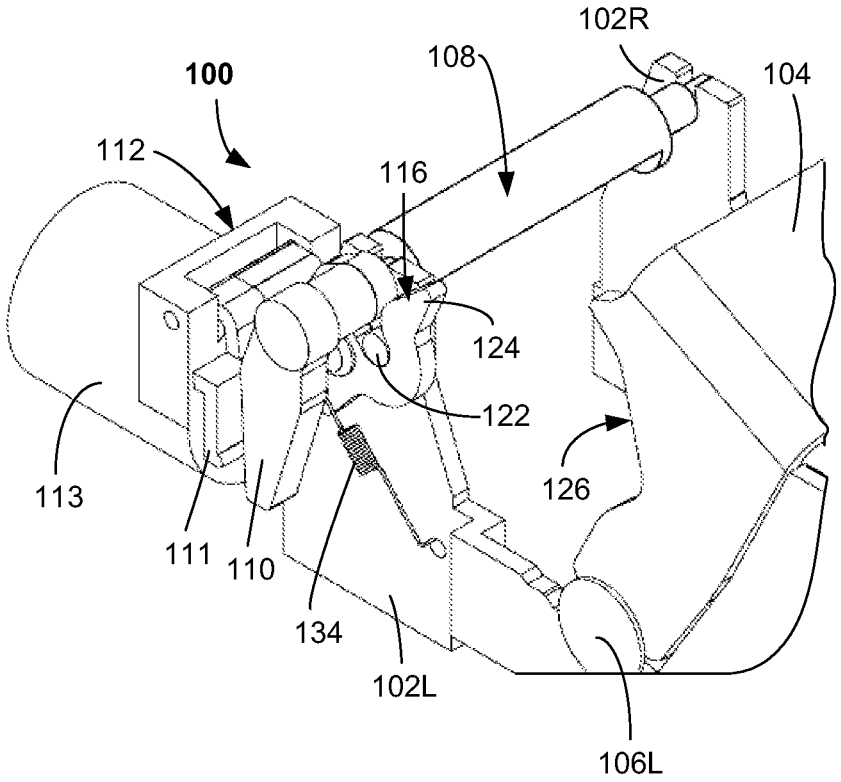

FIGS. 4A and 4B shows the circuit breaker trip blocking assembly 100 configured in an ON or TRIP configuration. As can be seen from FIGS. 4A and 4B, with the handle arm 104 in the on or tripped configurations, the blocking lever 116 is no longer contacted by the surface profile 126 of the handle arm 104. Accordingly, the blocking lever 116 rotates counterclockwise under the action of the return spring 134 and the blocking lever 116 comes to rest against the limit stop 122. The blocking lever 116 rotates sufficiently so that the circuit breaker may now trip.

FIG. 5A-5D illustrates isometric views of the various components of the trip blocking apparatus 101. For example, FIG. 5A illustrates an isometric view of an embodiment of the blocking lever 116. The blocking lever 116 may be manufactured from any suitably rigid material, such as steel. The third projection 138 may include a slot or groove 550 that is configured and adapted to receive an end of the return spring 134. Each of the apexes of the projections 124, 130, 138 may include a rounded profile, as shown. The relative lengths, L1, L2, L3 from the center hole 552 to the apex of each projection 124, 130, 138 may be L1>L3>L2, for example. In one or more embodiments, the length dimension L1 may be between about 40 mm and about 60 mm, or about 51 mm in the depicted embodiment, for example. In one or more embodiments, the length dimension L2 may be between about 5 mm and about 11 mm, or about 8 mm in the depicted embodiment, for example. In one or more embodiments, the length dimension L3 may be between about 9 mm and about 15 mm, or about 12 mm in the depicted embodiment, for example. Other length dimensions may be used. An L1/L2 ratio may be greater than about 3, or even greater than about 4, in order to reduce and to create a proper actuation stroke of the third projection 138.

FIG. 5C illustrates an isometric view of an embodiment of the kicker 111. The kicker 111 may be steel or other suitably rigid material. The actuation portion 111A may include a raised portion 554 that is adapted to contact the trip arm 110. The raised portion 554 may be rounded, for example. The pivot 111P may be formed by shaft ends 556A, 556B that pivot in the housing of actuator 113. The contour of the cam surface of the resetting portion 111R may be such that rapid, yet smooth resetting of the actuator 113 is accomplished when contacted by the third projection 138 of the blocking lever 116. Other cam profiles may be used. Furthermore, other configurations for the kicker 111 may be used. For example, the kicker 111 may be a portion of the moving portion of the actuator 113, for example.

As shown in FIG, 5D, the trip bar 108 includes ends 558A, 558B having reduced diameter regions that may be received in journal slots formed in the frame sides 102L, 102R. A flat portion 108F formed on an underside of the trip bar may engage a latch mechanism to trip the circuit breaker. The trip bar may be manufactured from a suitable rigid material, such as steel. Other suitable rigid materials may be used. Other constructions of the trip bar 108 may be used.

Figure 6:
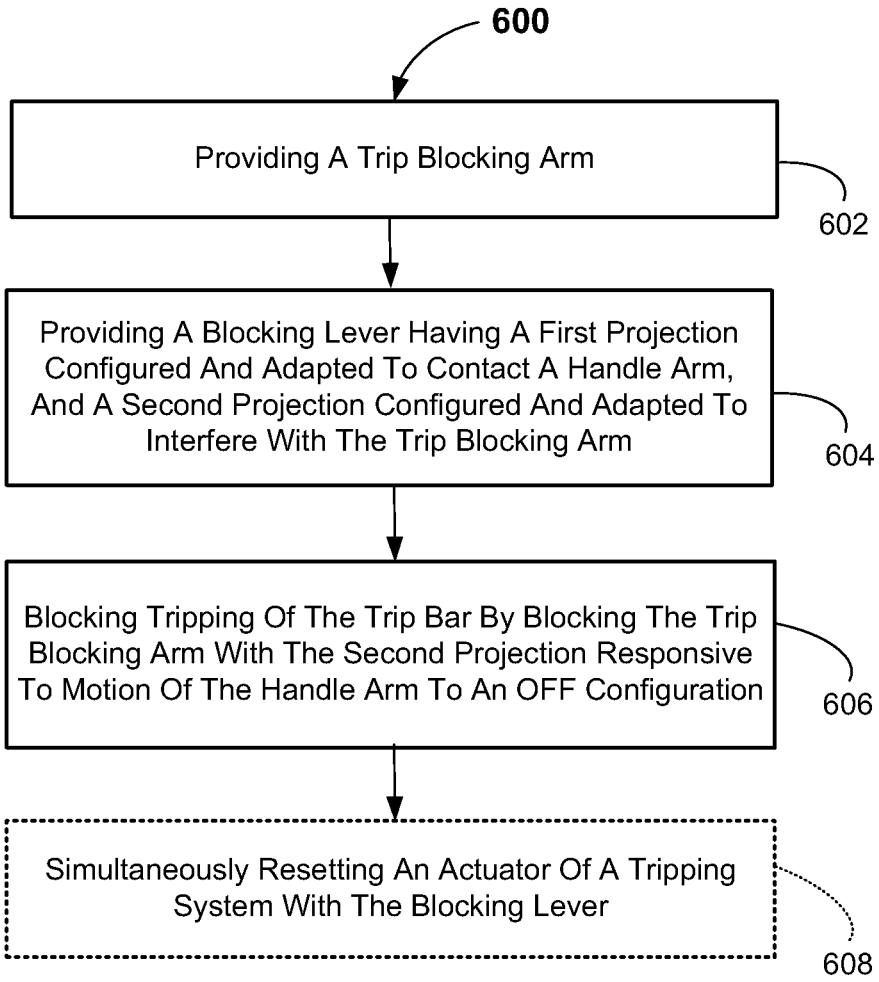
FIG. 6 shows a flowchart illustrating a method of operating a circuit breaker trip blocking assembly according to embodiments.

FIG. 6 is a flowchart illustrating a method 600 of operating a circuit breaker trip blocking assembly (e.g., circuit breaker trip blocking assembly 100) according to one or more embodiments. The method 600 includes providing a trip blocking arm (e.g., trip blocking arm 118) in 602. The method also includes, in 604, providing a blocking lever (e.g., blocking lever 116) having a first projection (e.g., first projection 124) configured and adapted to contact a handle arm (e.g., a surface profile 126 of the handle arm 104), and a second projection (e.g., second projection 130) configured and adapted to interfere with the trip blocking arm (e.g., trip blocking arm 118). In 606, the method 600 includes blocking tripping by blocking the trip blocking arm with the second projection (e.g., second projection 130) responsive to motion of the handle arm to an OFF configuration. The second projection 130 of the blocking lever 116 is rotated into an interfering position when the handle arm is moved to the OFF orientations (FIG. 1B) so that the trip bar 108 is limited in rotational extent to a relatively small amount insufficient to cause tripping of the circuit breaker. This provides a failsafe feature when in the OFF configuration so that the breaker cannot trip, i.e., the rotation of the trip blocking arm 118 is limited by the blocking lever 116 to rotations insufficient to cause tripping. The method 600 may additionally comprise simultaneously, as the handle arm (e.g., handle arm 104) is moved to and past the OFF configuration (e.g., to a RESET configuration), rotating the blocking lever (e.g., blocking lever 116) to cause resetting of an actuator (e.g., actuator 113)

of a tripping system (e.g., tripping system 112). This may be accomplished by the apex of the third projection 138 contacting the resetting portion 111R of the kicker 111. Thus, the circuit breaker trip blocking assembly 100 may not only block tripping in the OFF configuration, but may also advantageously reset the actuator 113 so that the tripping system 112 is again ready to trip. As discussed above, even after resetting, the resetting projection 138 of the blocking lever 116 may remain holding the actuator 113 of a tripping system 112 when returned to the OFF configuration after the resetting. Accordingly, the actuator cannot move in the OFF configuration. This broad feature is capable of use independent of the blocking of the trip bar 108.

While the invention is susceptible to various modifications and alternative forms, specific embodiments and methods thereof have been shown by way of example in the drawings and are described in detail herein. It should be understood, however, that it is not intended to limit the invention to the particular apparatus, systems, or methods disclosed, but, to the contrary, the intention is to cover all modifications, equivalents, and alternatives falling within the scope of the invention.

What is claimed is:

1. A circuit breaker trip blocking apparatus, comprising:
a trip bar having a trip blocking arm; and
a blocking lever having
a first projection configured and adapted to contact a handle arm, and
a second projection configured and adapted to block tripping of the trip bar responsive to motion of the handle arm,
wherein the blocking lever includes a pivot,
wherein the pivot is mounted for rotation relative to a frame.

2. The circuit breaker trip blocking apparatus of claim 1, wherein tripping of the trip bar is blocked by the second projection when the handle arm is in an OFF position.

3. The circuit breaker trip blocking apparatus of claim 2, wherein the handle arm comprises a profile surface adapted to be contacted by the first projection.

4. The circuit breaker trip blocking apparatus of claim 1, wherein the trip blocking arm comprises a projection from a trip bar shaft.

5. The circuit breaker trip blocking apparatus of claim 1, wherein the trip blocking arm is located adjacent to a trip arm.

6. The circuit breaker trip blocking apparatus of claim 1, wherein a first angle between a first midline extending from the pivot through an apex of the first projection and second midline extending from the pivot through an apex of the second projection is between about 100 degrees and about 120 degrees.

7. The circuit breaker trip blocking apparatus of claim 1, wherein the trip bar comprises a trip arm adapted to be contacted by a kicker when actuated by an actuator of a tripping system.

8. The circuit breaker trip blocking apparatus of claim 7, comprising a third projection extending from the blocking lever, the third projection being configured and adapted to contact the kicker to reset an actuator of the tripping system.

9. The circuit breaker trip blocking apparatus of claim 8, comprising a return spring coupled to the third projection.

10. The circuit breaker trip blocking apparatus of claim 1, wherein the blocking lever comprises a recess adapted to receive a limit stop.

11. A circuit breaker trip blocking apparatus, comprising:
a trip blocking arm;
a tripping system having a kicker adapted to be moved by an actuator; and
a blocking lever having
a blocking projection configured and adapted to block the trip blocking arm, and
a resetting projection configured and adapted to reset the actuator.

12. The circuit breaker trip blocking apparatus of claim 11 wherein the resetting projection remains in contact with the kicker after reset and return to an OFF configuration.

13. A circuit breaker trip blocking apparatus, comprising:
a tripping system having a kicker adapted to be moved by an actuator; and
a blocking lever having
a first projection configured and adapted to contact a handle arm, and
a reset projection configured and adapted to reset the actuator and block actuation of the actuator in an OFF configuration.

14. The circuit breaker trip blocking apparatus of claim 13 wherein the reset projection remains in contact with the kicker after reset and return to an OFF configuration.

15. The circuit breaker trip blocking apparatus of claim 13 wherein the blocking lever has a blocking projection configured and adapted to block a trip blocking arm of a trip bar.

16. A circuit breaker trip blocking assembly, comprising:
a frame;
a handle arm pivotable relative to the frame about a handle arm pivot, the handle arm including a profile surface;
a trip bar having trip arm and a trip blocking arm;
a tripping system having a kicker and an actuator, the trip arm adapted to be contacted by the kicker when moved by the actuator; and
a blocking lever pivotable relative to the frame, the blocking lever having
a first projection configured and adapted to contact the profile surface, and
a second projection adapted to interfere with the trip blocking arm to block tripping of the trip bar responsive to motion of the handle arm.

17. A method of operating a circuit breaker trip blocking assembly, comprising:
providing a trip blocking arm;
providing a blocking lever having a first projection configured and adapted to contact a handle arm, and a second projection configured and adapted to interfere with the trip blocking arm;
blocking tripping of the trip bar by blocking the trip blocking arm with the second projection responsive to motion of the handle arm to an OFF configuration;
providing a tripping system having a kicker and an actuator;
providing a third projection on the blocking lever; and
resetting the actuator by movement of the kicker with the third projection.

18. The method of claim 17, comprising contacting a cam surface with the third projection to cause the movement of the kicker.

19. The method of claim 17, comprising rotating the blocking lever to block tripping of the trip bar by contacting and moving the first projection along a profile surface of the handle arm when moving the handle arm towards the OFF configuration.

20. The method of claim 17, rotating the blocking lever to unblock the trip bar under the action of a return spring as the handle arm is moved to an ON configuration.

21. The method of claim 17, comprising stopping rotation of the blocking lever by contacting a limit stop with the blocking lever.

22. The method of claim 17, comprising simultaneously, as the handle arm is moved past the OFF configuration, rotating the blocking lever to cause blocking of the trip bar, and resetting an actuator of a tripping system.

23. The method of claim 22, comprising:

holding the actuator of a tripping system with the blocking lever when returned to the OFF configuration after the resetting.

* * * * *